US006860280B2

(12) United States Patent
Wolcott

(10) Patent No.: US 6,860,280 B2
(45) Date of Patent: Mar. 1, 2005

(54) QUICK SET-UP AND TAKE-DOWN UMBRELLA SYSTEM FOR RECREATIONAL ACTIVITIES

(76) Inventor: Steve Wolcott, P.O. Box 147, Paonia, CO (US) 81428

( * ) Notice: Subject to any disclaimer, the term of this patent is extended or adjusted under 35 U.S.C. 154(b) by 0 days.

(21) Appl. No.: 10/313,464

(22) Filed: Dec. 4, 2002

(65) Prior Publication Data

US 2003/0127120 A1 Jul. 10, 2003

Related U.S. Application Data

(60) Provisional application No. 60/338,283, filed on Dec. 4, 2001.

(51) Int. Cl.[7] ..... A45B 25/00
(52) U.S. Cl. ..... 135/21
(58) Field of Search ..... 135/16, 20.1, 21, 135/90, 19.5

(56) References Cited

U.S. PATENT DOCUMENTS

| | | | | | |
|---|---|---|---|---|---|
| 2,993,216 | A | * | 7/1961 | Casey | 135/21 |
| 3,032,046 | A | * | 5/1962 | Coonradt | 135/90 |
| 3,120,238 | A | * | 2/1964 | Glatz | 135/21 |
| 3,304,035 | A | * | 2/1967 | Davis | 248/516 |
| 3,345,786 | A | * | 10/1967 | Buzzella et al. | 52/73 |
| 3,383,814 | A | * | 5/1968 | Rowe | 52/83 |
| 3,637,046 | A | * | 1/1972 | Emmons | 182/170 |
| 3,765,434 | A | * | 10/1973 | Riggs | 135/20.1 |
| 4,202,363 | A | | 5/1980 | Watts et al. | 135/2 |
| 4,284,095 | A | * | 8/1981 | Norton | 135/21 |
| 4,304,068 | A | | 12/1981 | Beder | 47/17 |
| 4,326,301 | A | * | 4/1982 | Brock | 2/171.02 |
| 4,586,525 | A | | 5/1986 | Glatz et al. | 135/20 A |
| 4,606,366 | A | | 8/1986 | Collet | 135/20 A |
| 4,945,936 | A | | 8/1990 | Surrendi | 135/98 |
| 5,002,081 | A | | 3/1991 | Stromeyer | 135/21 |
| 5,116,258 | A | | 5/1992 | Vennik | 135/20.3 |
| 5,499,644 | A | | 3/1996 | Geniele | 135/20.1 |
| 5,678,585 | A | | 10/1997 | May | 135/20.1 |
| 5,775,250 | A | * | 7/1998 | Kobayashi et al. | 114/258 |
| 5,785,069 | A | | 7/1998 | Glatz | 135/20.1 |
| 5,803,104 | A | * | 9/1998 | Pollen | 135/96 |
| 5,823,213 | A | * | 10/1998 | Patarra | 135/16 |
| 5,836,327 | A | * | 11/1998 | Davis | 135/16 |
| 5,845,665 | A | | 12/1998 | Koehn | 135/98 |
| 5,937,881 | A | * | 8/1999 | Villa | 135/20.1 |
| 5,941,261 | A | | 8/1999 | Kouvaras et al. | 135/27 |
| 5,960,806 | A | | 10/1999 | Steiner | 135/20.1 |
| 6,085,766 | A | * | 7/2000 | Geary | 135/75 |
| 6,105,594 | A | * | 8/2000 | Diaz | 135/16 |
| 6,152,156 | A | | 11/2000 | Tung | 135/21 |
| 6,196,242 | B1 | | 3/2001 | Xu | 135/20.1 |
| 6,220,261 | B1 | | 4/2001 | Glatz | 135/20.3 |
| 6,405,742 | B1 | * | 6/2002 | Driscoll | 135/96 |
| 6,561,178 | B1 | * | 5/2003 | Hayes | 126/25 R |
| 6,588,037 | B1 | * | 7/2003 | Eno et al. | 5/419 |
| 6,662,815 | B2 | * | 12/2003 | Tung | 135/20.1 |
| 2001/0007260 | A1 | | 7/2001 | Rousselle et al. | 135/98 |
| 2003/0041889 | A1 | * | 3/2003 | Lin et al. | 135/16 |
| 2003/0192580 | A1 | * | 10/2003 | Tung | 135/20.1 |
| 2003/0230326 | A1 | * | 12/2003 | Lin | 135/20.1 |

* cited by examiner

*Primary Examiner*—Leslie A. Braun
*Assistant Examiner*—Kofi Schulterbrandt
(74) *Attorney, Agent, or Firm*—Pedersen & Co., PLLC; Ken J. Pedersen; Barbara S. Pedersen

(57) ABSTRACT

An umbrella system for rafts and other moving vehicles is described. The umbrella system includes a support system offset from the umbrella so that the support mast. The support system also includes one or more quick-connection/quick-disconnection systems so that the umbrella system can be quickly removed from the raft or vehicle and disassembled into several, shorter, more compact parts. The preferred umbrella opening and closing system does not include cables, cranks, or other complex structure, but rather is made from a handle underneath the center of the umbrella that can be manually pushed and pulled upward and downward, respectively, to open and close the umbrella. The umbrella system can be adjusted to shade a large area by a few simple adjustments of a preferred pivotal joint, or by quick detachment of the support system from the raft and re-attachment in another location on the raft, for example.

12 Claims, 7 Drawing Sheets

QUICK SET-UP AND TAKE-DOWN UMBRELLA SYSTEM FOR RECREATIONAL ACTIVITIES

DESCRIPTION

This application claims priority of our prior, provisional patent application, Ser. No. 60/338,283, filed on Dec. 4, 2001, now abandoned, entitled "Quick Set-Up and Take-Down Umbrella System for Recreational Activities," which is incorporated herein by reference.

BACKGROUND OF THE INVENTION

1. Field of the Invention

This invention relates generally to umbrellas for shading people from the sun or the elements. More specifically, the invention relates to umbrellas that may be used on river rafts and boats, on other vehicles, and in other recreational settings. The invention relates specifically to an umbrella system that can be quickly set-up or taken down, quickly adjusted, and that is lightweight and easily-operated during travel on a raft or other moving equipment.

2. Related Art

There are many umbrellas for shading people and areas, such as cafe umbrellas and personal umbrellas. Conventionally, these umbrellas fall into the two main categories depending on how the umbrella is supported.

The first category is the umbrella that is supported from below, by a centrally-located pole at the axis of the umbrella fabric shade portion, such as in a conventional hand-held umbrella or patio table umbrella. In this first category, the space underneath the umbrella is limited, because the support pole takes up space and obstructs movement underneath the umbrella.

The second category is the umbrella that is suspended from above, typically by an arm on a support pole that reaches over the umbrella shade portion and connects to the center of the shade portion. Examples of the second category of umbrellas are found in the patent literature, including Xu (U.S. Pat. No. 6,196,242 issued Mar. 6, 2001); Tung (U.S. Pat. No. 6,152,156 issued Nov. 28, 2000); Steiner (U.S. Pat. No. 5,960,806 issued Oct. 5, 1999); Koehn (U.S. Pat. No. 5,845,665 issued Dec. 8, 1998); Glatz (U.S. Pat. No. 5,785,069 issued Jul. 28, 1998); Vennik (U.S. Pat. No. 5,116,258 issued May 26, 1992); Glatz, et al. (U.S. Pat. No. 4,586,525 issued May 6, 1986). These umbrellas include complex opening and closing systems, including cables, cranks, locks, hinges and pivots. The shade and support structure of such umbrellas are typically complex, heavy, and difficult to operate, because the cable extends typically from the lower central axis of the umbrella shade portion, through the umbrella axis, suspension arm and all the way to the lower end of the support pole, and because a crank and lock mechanism is needed to control movement of the cable. Consequently, these complex umbrellas are not very portable or quickly-operated, so that they are used in situations in which the umbrella is stationary, on a patio or street, and does not need to be moved or frequently opened or closed.

Several umbrellas use complex pivot arm and boom systems, such as Glatz (U.S. Pat. No. 6,220,261 issued Apr. 24, 2001); Geniele (U.S. Pat. No. 5,499,644 issued Mar. 19, 1996); May (U.S. Pat. No. 5,678,585 issued Oct. 21, 1997; and Collet (U.S. Pat. No. 4,606,366 issued Aug. 19, 1986). Like the cable-operated umbrellas, these umbrellas are complex, and tend to be heavy and difficult to operate.

SUMMARY OF THE INVENTION

An object of the present invention is to provide a portable and easily-operated umbrella, which is convenient for recreational and vehicle applications. Another object is to provide a quickly-disassembled and quickly-assembled umbrella, which can be set-up and operated without complex instructions, so that the umbrella may be quickly deployed, for example, on a raft or boat.

The present invention is an umbrella system that comprises a shade portion and a support system, which connect to each other and to a supporting surface in a manner that allows quick-connection and quick-disconnection. The invented umbrella system includes an easily-operated opening and closing system that is accessible underneath the umbrella shade central axis, wherein the user opens and "locks" the shade with one single upwards motion, and "unlocks" and collapses the umbrella in one single downwards motion. The simplicity of construction and operation and the quick-connect features of the umbrella system make it especially beneficial for river rafting and other activities in which the user needs a light weight umbrella and has limited time and limited footing and maneuvering room in which to install and operate an umbrella.

Preferred embodiments include quick-connection of the support structure to the umbrella shade portion and quick-connection of the support structure to a boat, raft, or vehicle surface. In addition, the support system may be disassembled at one or more quick-connections into smaller lengths. The preferred support structure comprises a support mast for connection to the boat, raft or vehicle surface, and a support arm extending from the mast. The support structure of the umbrella system preferably includes a joint, such as a ball joint, for allowing movement of the umbrella in multiple directions and locking of the umbrella position in those multiple positions.

The umbrella shade hangs from a support arm that is preferably adapted to place the umbrella shade a distance from the support mast, for example, by means of the support arm being curved away from the axis of the support mast. The umbrella shade preferably opens by means of a handle located on a hub at the shade axis, which handle and hub are moveable along the shade axis to raise and lower the inner ends of push-rods, whereby the umbrella shade portion is raised and lowered. Preferably, the handle is used to push the inner ends to a "past-horizontal" position, in which position the shade is retained in the open position because of the relative position and forces exerted by the shade on the push-rods, the push-rods on the hub, and the hub on the center of the umbrella shade. To collapse the preferred umbrella shade, the handle is pulled down, which brings the push-rods down past the center position so that they may pivot down to generally parallel to the shade axis, bringing the shade fabric with them into the collapsed position. Thus, preferably, only the user's pulling of the handle upward and downward is needed to control the umbrella.

Light weight, strong materials may be used for the support mast, arm, and fabric shade, and, because there need be no internal workings or parts, except perhaps parts of the quick-connections or a ball joint, the umbrella system may be light-weight and easily portable and storable on a boat, raft, or other vehicle. Preferred embodiments of the invented umbrella system do not require cables, cable-locks, or movement of the support system for operation of the opening/closing mechanism. The preferred retaining system is workable due to the forces caused by the relative positioning of the walls of the umbrella shade, the push-rods, and the slidable hub at the umbrella axis.

BRIEF DESCRIPTION OF THE DRAWINGS

FIG. 6 illustrates a biased-arm system, in which a tab is biased by a flexible arm to extend through a hole in the outer tube and into a hole or recess in the inner tube of the quick-connection being made. FIG. 7A illustrates a single-snap-button connection, and FIG. 7B illustrates a double-snap-button connection.

DESCRIPTION OF THE PREFERRED EMBODIMENTS

Figure 1A:
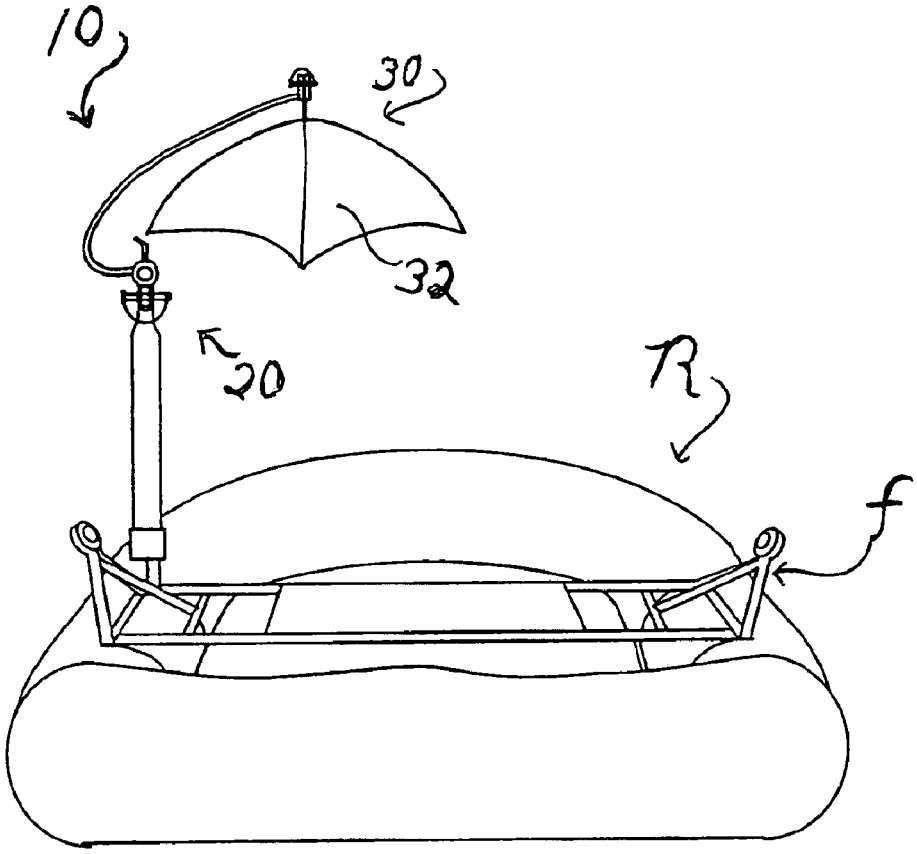
FIG. 1A is a perspective view of one embodiment of the invention in use on a river raft, wherein the umbrella shade axis is in a generally vertical position, offset from but parallel to the mast axis.
Figure 1B:
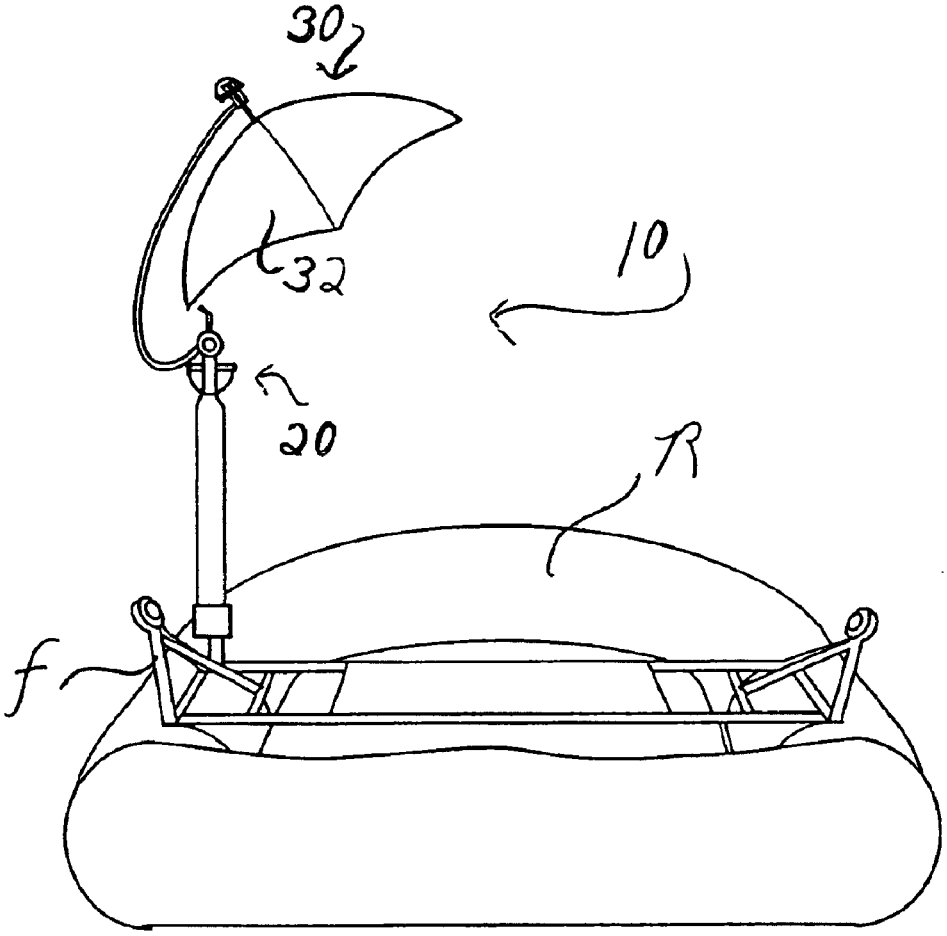
FIG. 1B is a perspective view of the embodiment of FIG. 1A, with the support system of the embodiment adjusted to tilt the umbrella shade axis to a non-vertical position that is off-set from and non-parallel to the mast axis.
Figure 2:
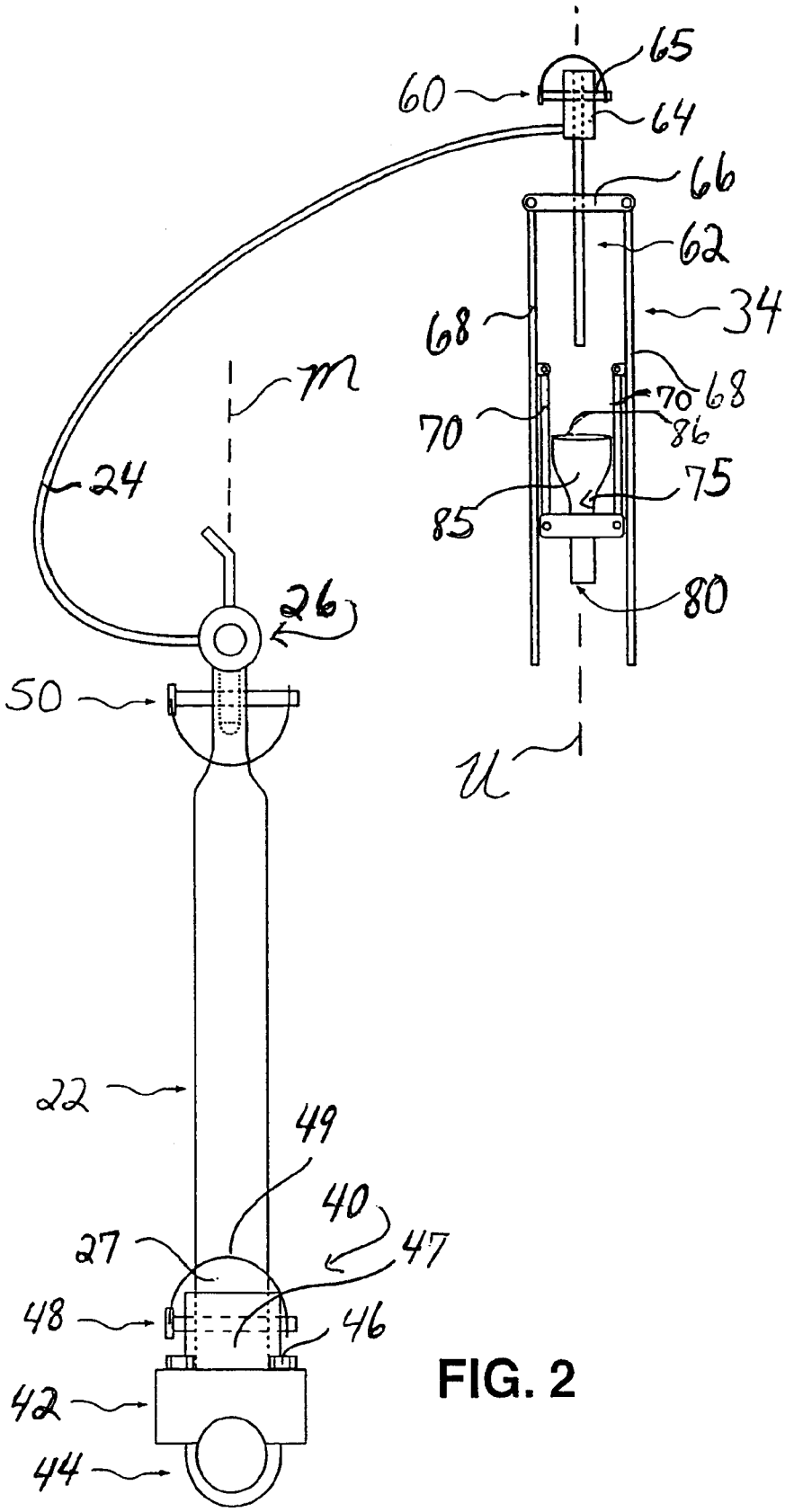
FIG. 2 is a schematic side view of the embodiment of FIG. 1, with the umbrella in a collapsed position, and fabric removed to shown the umbrella opening and closing system.
Figure 3:
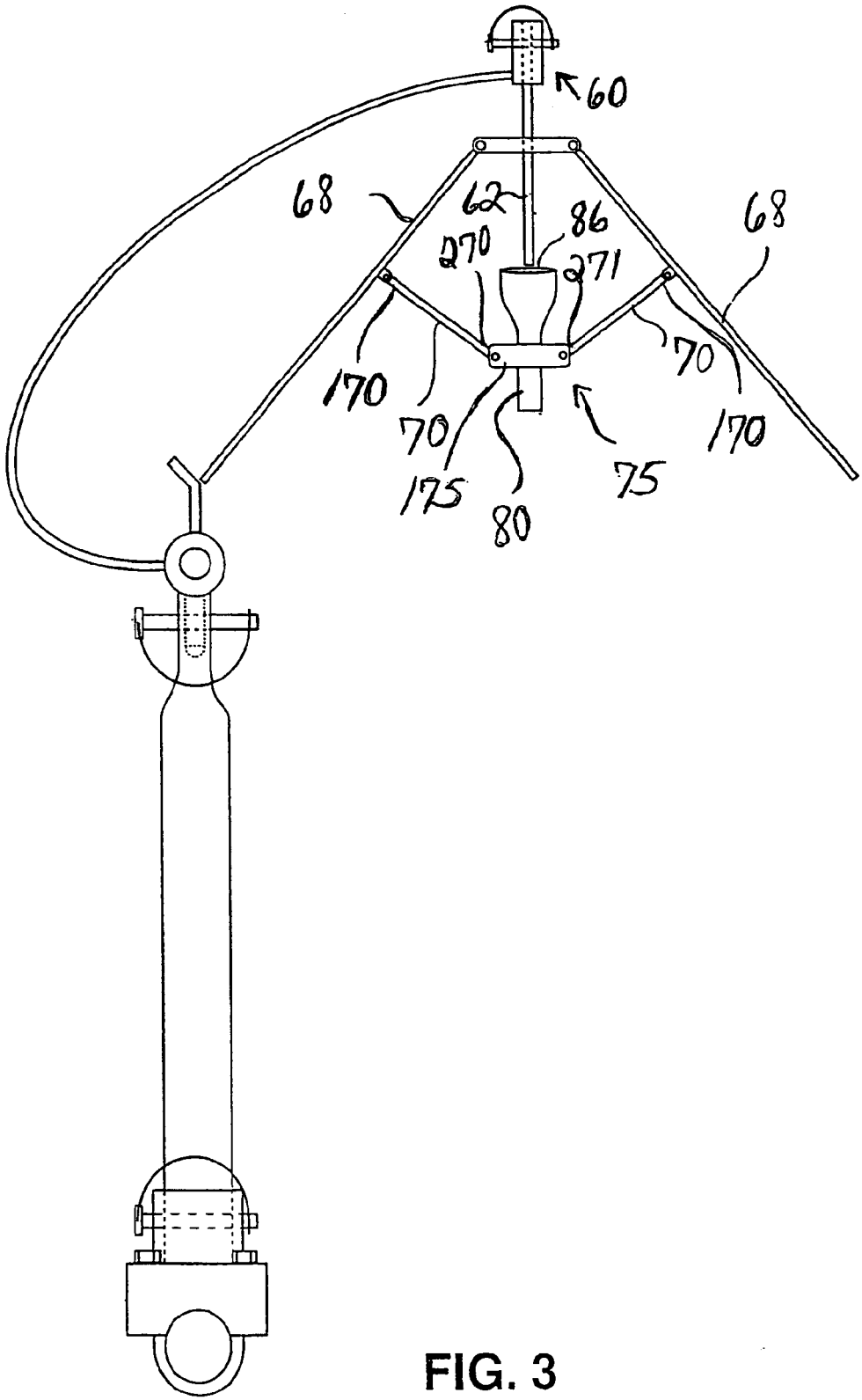
FIG. 3 is a schematic side view of the embodiment of FIG. 2, with the umbrella being in the process of being opened.
Figure 4:
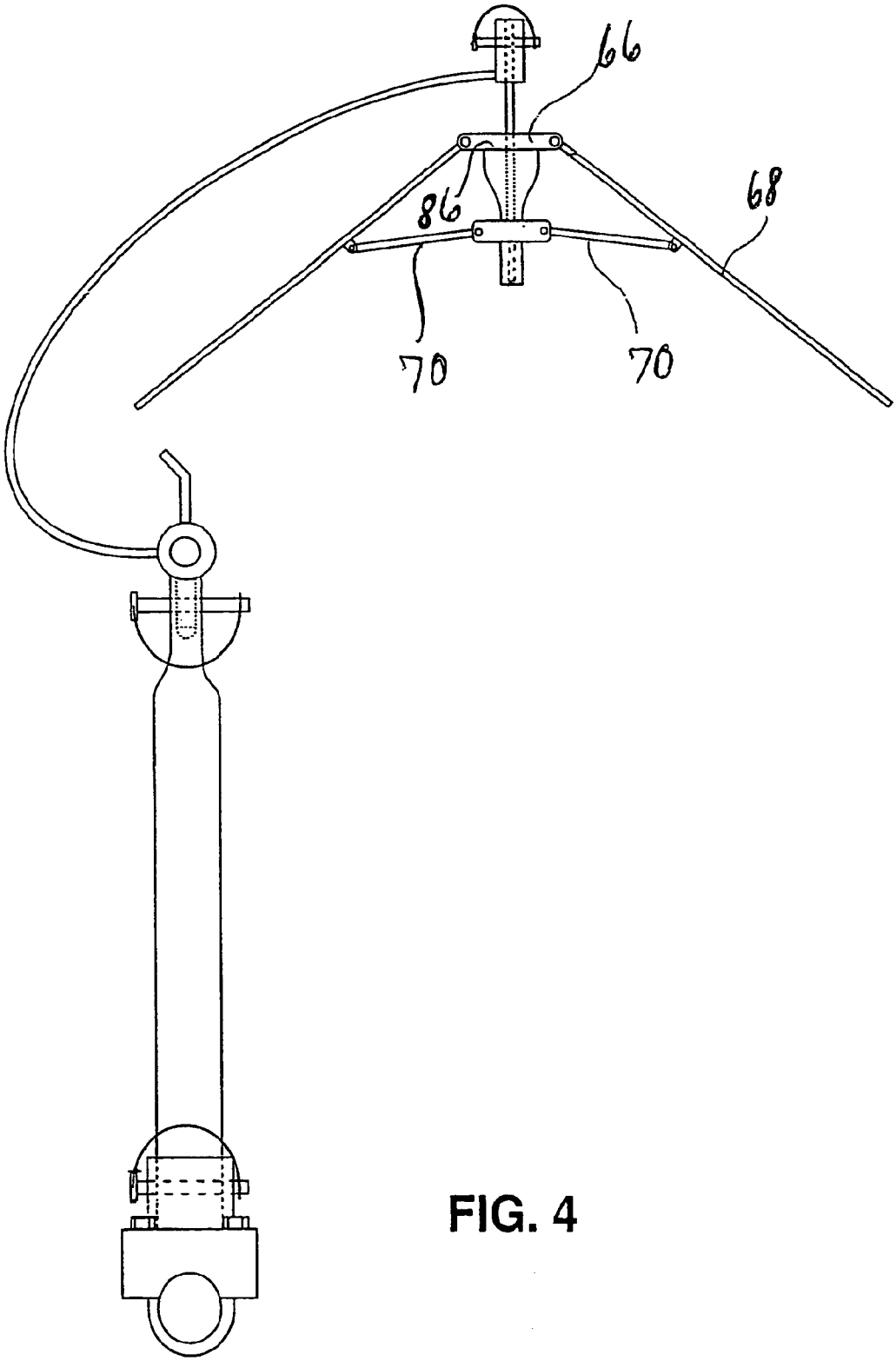
FIG. 4 is a schematic side view of the embodiment of FIGS. 2 and 3, with the umbrella fully opened for use.

Referring to the Figures, there are shown several, but not the only, embodiments of the invented umbrella system, and components thereof. FIG. 1A illustrates the preferred embodiment of the umbrella system 10 in use on a river raft "R", in a generally non-tilted position, wherein the umbrella axis is generally parallel, but offset from, the axis of the mast that attaches to the raft frame "F." FIG. 1B illustrates the preferred embodiment of the umbrella system on the raft, with a joint adjusted to tilt the umbrella to an alternative position, wherein the umbrella axis if non-parallel to the mast axis. This way, the umbrella shade may be tilted to various positions over the raft, depending on the location of the sun relative to the raft and depending on the position of the people in the raft. FIGS. 2 to 4 illustrate details and operation of the preferred embodiment. FIGS. 5–11 illustrate various quick-connections for the multiple connections in the support structure of the umbrella system.

By looking at the side views in FIGS. 2–4, there are shown the support system 20 and the umbrella 30 of the umbrella system 10. The support system 20 comprises a mast 22, an arm 24, and quick-connections, and the umbrella comprises the shade 32 and its opening/closing system 34. The axis "U" of the umbrella may be parallel to the axis of the mast "M," but, with the preferred adjustable and lockable joint between the arm 24 and the mast 22, the umbrella may also be adjusted out of parallel alignment with the mast to "tilt" to many desired positions. This preferably adjustable and lockable joint may be a ball joint 26 or other connection that allows the umbrella to hang at an angle. For clarity of description, rather than a limitation, the mast is herein described as vertical, but one may see that the mast could be attached to a surface at other than vertical orientation.

The mast 22 preferably is attached to a member of a raft frame F by a quick-connection. The quick-connection may comprise a bracket system 40 that is rigidly attached to the frame, and the proximal end 27 of the mast sliding into or otherwise joining to the bracket system 40. The bracket body 42 of the bracket system may attach to the raft frame by means of a U-bolt 44 surrounding a part of the frame, a plate bolted onto the frame, or other fastening means. A preferred bracket system comprises two u-bolts (one is visible in FIGS. 2–4 and one is hidden behind the visible u-bolt) that surround a cylindrical frame member on a raft. The u-bolts extend up into the bracket body 42 and are bolted by nuts 46 to the bracket body, wherein tightening the nuts on the u-bolts 44 serves to tighten the bracket body 42 onto the frame in a very secure and non-rotational manner. A bracket cylindrical sleeve 47 upends from the bracket body 42 and receives the lower end (proximal end 27) of the preferred mast. A pin system 48 or other quick-removable fastener is used to anchor the mast into bracket cylindrical sleeve 47 in a manner that prevents the mast from rotating relative to said sleeve and, hence, the raft frame. In this way, a very secure connection may be made between the mast and the frame, with the quick-detach feature but with little or no chance of the mast coming out of the bracket system. Various quick-connections may be used, in order to allow a user to easily connect the mast to the bracket system with one or two simple motions, for example, and to disconnect the mast from the bracket system, again in one or two simple motions, both being done without the need for tools. Preferably, the connection is done by inserting the mast into the bracket and one simple latching motion or an automatic latching by a retaining strap or a biased latch, for example. The disconnection is preferably operated by an unlatch motion with one hand, and the mast is lifted out of the bracket with the other hand, again without tools, so that the disconnection is easy but is not likely to be done by mistake.

For example, a preferred quick-connection comprises a pin connection system, wherein a pin is slid through aligned holes in the bracket and the mast, which pin is normal to the mast axis and which may be inserted or pulled out quickly when desired, but which is retained by a retaining strap 49, latch, friction fit, or other means so that the pin does not fall out during movement of the raft. An alternative quick-connection may be a detent mechanism, such as a ball or tab located inside the mast and protruding out from the mast to engage the bracket when the mast is inserted into the bracket. Preferably, such a detent ball or tab protrudes out from the surface of the mast and is biased outward into an aperture in the bracket when the mast and bracket are properly connected and aligned. When disconnection is desired, the user presses inward on the ball to let the mast clear the ball as the user pulls the mast out of the bracket. Other quick-connection mechanisms may be used, with an especially-preferred connection comprising a double-snap-button connection shown in FIG. 7B and described below.

Preferably, the mast 22 is a telescoping mast or other height-adjustable mast. The mast may have, for example, two telescoping pieces (not shown) of steel tubing with a clamp at the end of the outer tube to secure the two telescoping pieces relative to each other after the user has adjusted them to adjust the total height of the mast. Preferably, the two pieces, when unclamped, may rotate relative to each other on their longitudinal axis, so that the user may rotate the upper piece of the mast relative to the lower piece of the mast to change the location of the umbrella shade. This may be particularly useful, for example, when the ball joint 26 has already been adjusted for a particular tilt of the umbrella shade, and the user wants the umbrella rotated to a new position without the umbrella changed. Thus, more adjustments are possible as the raft travels down a river and/or as the sun position changes in the sky.

The arm 24 is preferably connected to the mast 22 by a quick-connection, which may be of various types as discussed above, but is preferably of the same type as the mast-to-bracket connection, for the user's convenience. From its connection to the mast, the arm preferably curves up and to one side of the mast in about a 180 degree arc to position the distal end of the arm above the mast and offset from the mast longitudinal axis "M."

In addition, the arm 24 may pivot in one or more directions and/or may swivel relative to the mast. In the preferred embodiment of FIGS. 2–4 the arm is connected to the mast by a lockable ball joint 26 near the quick-connection 50, so that the arm may swing and swivel into many different positions in a three-dimensional space, for example, to move the distal end of the arm along x, y, and z axis, for example, for placement of the umbrella into preferred positions for shielding the raftsmen from the sun as they wind their way down a river. By locking the position of the arm after it has been adjusted, the user may ensure the arm will not swing out of the favored position until the user purposely moves it to a different position. Alternatively, the arm's pivotal joint may be at other locations besides near the quick-connection to the mast. One may envision that a pivotal joint nearer the middle of the arm may be workable, but less preferred as it may be less accessible to a rider in the raft.

Because of the preferred quick-connection system, the off-set support system, and the preferred joint between the mast and the arm, the umbrella system has great versatility and effectiveness in use on rafts, boats, and other vehicles. Having the umbrella suspending down from the support system 20 (mast and arm) and having the support system offset from the umbrella axis, allows the umbrella to reach over the raft and the rafters, so that they are not working around or obstructed by the support system. The preferred joint between the mast and arm allow the user to adjust the position of the umbrella for optimum shade and shelter.

The umbrella is preferably connected to the arm by a quick-connection 60. This quick-connection may be of various types, as discussed above, but preferably is the one that is easily operable from the position of standing up in a raft, boat or vehicle. A preferred quick-connection 60 for attachment of the umbrella to the arm comprises the umbrella center shaft 62 extending above the shade fabric 32 an extent that allows it to be received inside a vertical cylindrical sleeve 64 at the distal end of the arm. A pin 65 or other quickly-releasable fastener may secure the center shaft 62 coaxially inside the cylindrical sleeve 64, so that the center shaft hangs from the cylindrical sleeve and is prevented from rotating relative to the sleeve.

The arm and the mast are both preferably rigid, and all the joints and adjustments are preferably lockable. This way, once the mast is adjusted in height and rotational position, and the arm adjusted in angle and rotational position relative to the axis of the mast, for example, by use of the ball joint, then the umbrella is anchored in substantially a single position relative to the raft and the users for use.

A user typically would disassemble the umbrella system as follows:

Fold (collapse) the umbrella and secure it in the folded position with a strap sewn to the cover wrapped around it and fastened by a quick fastener such as velcro, a snap, or cam-lock buckle. Disconnect the umbrella from the arm, disconnect the arm from the mast, and then disconnect the mast from the mounting bracket. The umbrella system later may be reinstalled on the raft in generally the reverse order of these steps.

With the preferred three quick-connections, the umbrella, arm and mast may be separated from each other and the mast removed from the raft, and the three sections may be stowed or removed from the raft in a compact grouping. The length of the sections are typically, but not limited to, about 39 inches for the mast, about 36 inches for the arm, and about 44 inches for the collapsed umbrella, so that the total package when the sections are laid side-by-side is about 44 inches long×20 inches wide×4 inches deep. This package is easily stowed and carried inside an elongated canvas or Rip-Stop™ bag.

The umbrella shade portion 32 may be a thin, fabric cone-shaped construction which takes its preferably smooth, unfolded large-diameter shape when expanded into the open position, and which collapses into a folded, small diameter cone-shape around its opening and closing mechanism. By "fabric," it is meant that a flexible cloth, plastic, canvas, or other sheeting may be used, such as the materials used for hand-held conventional rain umbrella or patio umbrellas. The especially-preferred fabric is canvas, as it is durable, lightweight and flexible. Reinforced plastic may also be used. Generally water-repellent and generally non-water-absorbing fabrics may be beneficial for river-use, as they may shield the rafters from rain and spray and retain little water and/or dry quickly after contact with water.

The umbrella has a center member 66 at its axis U, and the fabric extends out and downward generally symmetrically from the center member 66 to form the shade. The shade may extend to have a circumference as designed by the manufacturer to fit various uses and sizes, but is preferably a four-bow (and four-push-rod) design that is about 55 inches square (and about 75 inches measured diagonally) when opened. The shade is attached to several bow 68 that extends radially out from, and pivot relative to, the center member. As in many umbrellas, as the bows 68 pivot downward and upward, they close and open the umbrella, respectively.

Connected to the bows about midway along their lengths are push-rods 70, each of which push-rods pivots relative to its bow. The push-rods 70 extend from the bows 68 radially toward the umbrella axis, and are pivotally connected at their inner ends to a hub unit 75. Extending downward from the hub unit 75 (either by attachment to or integral formation with the hub transverse portion) is the handle 80, which may be grasped by the user to raise and lower the hub unit 75 toward and away from the center member 66. As shown in FIG. 3, when the handle is pushed up toward the center member 66, the hub unit 75 (combination of transverse hub portion 175, handle 80, and, as discussed below, a funnel 85) pushes the push-rods 70 upwards, and the push-rods in turn push on their respective bows 68.

When in the collapsed or semi-collapsed position, the hub unit 75 is distanced from the center member 66, and no cable or other structure extends between the center member and the hub unit. As the umbrella is opened, the hub unit 75 moves closer to the center member 66 and the upwardly-extending funnel extension 85 (or "funnel") receives and is guided by the center shaft 62 along the longitudinal axis of the umbrella, so the accurate, effective opening occurs without bending of the bows 68 or push-rods 70. The funnel extension 85 preferably has a hollow, funnel shape that is wide at the top end and narrow at the lower end for cooperating with the center shaft 62 extending down from the center member. As shown in FIG. 3, as the umbrella is being opened, the funnel extension 85 may come into contact with the center shaft 62 prior to the push-rods pivoting "past horizontal," and preferably at about the time the push-rods are at about 45 degrees to the umbrella axis with their inner ends further from the center member than are their outer ends.

Preferably, the funnel interior walls smoothly transition from the wide top end to the relatively narrow lower end, without ledges or shoulders on which the center shaft might catch or lodge. The enlarged top opening of the funnel 85 receives the center shaft 62 and the slanted interior wall surface slides along the center shaft if there is any off-center movement of the handle, so that the funnel becomes centered as it moves toward the shape center member. When the umbrella shade is fully open, the center shaft 62 is centered in the funnel lower end (the handle 80 end, which has a straight, cylindrical wall) with a close fit between the straight interior wall of the funnel lower end and the outer surface of the center shaft lower end. This way, the hub unit 75 is well-aligned with the center member 66 and not prone to wobble or allow the push-rods, the bows, or the fabric shade to move away from a proper aligned, stable, and effective position. Because the funnel 85 centers the center shaft 62 on the umbrella axis, the push-rods and bows are not allowed to move significantly from their positions symmetrically disposed around the umbrella axis U, and they are not likely to become dislodged and to allow the umbrella to accidently close.

When the funnel reaches the center member, the funnel top edge 86 abuts against the center member 66 and is prevented from traveling any further upwards. During opening to the extent wherein the funnel 85 abuts against the center member 66, the push-rods pivot inward and upward toward a level position, that is, transverse or perpendicular to the umbrella axis. When the umbrella axis is vertical, the transverse position of the push-rods may be called horizontal. The compression force against the push-rods is the greatest in this position, as the push-rods outer ends 170 are the farthest from the umbrella axis, and, hence, are pushing out against the bows and against the fabric to the greatest extent. As the user continues to push the handle up from the horizontal-push-rod position, the push-rods of the preferred embodiment pivot up "past center," so that they are inclined slightly upwards from their outer ends 170 to the inner ends 270, as shown in FIG. 4. In this position, the force exerted by the fabric on the bows 68, and, hence, to the push-rods 70, pushes the push-rods inner ends 270 into the hub portion 175 to push the funnel against the center member 66, which is retained at its highest position. Therefore, no latch or other lock needs to be provided to attach the funnel 85 to the center member 66. Further force on the outside of the fabric shade only acts to force the funnel and center member together harder. The push-rod position when the umbrella is fully opened is designed to be just slightly above horizontal, that is, about 2–15 degrees, and most preferably only about 3–5 degrees. The umbrella is thus "locked" in the open position shown in FIG. 4 without any other latches, without cables, and without additional actions by the user. The push-rods and bows are sized and positioned relative to one another so that normal forces by users and the elements against the inside of the umbrella will not turn the umbrella inside-out. As shown in FIG. 4, preferably the center shaft has a length so that, when the umbrella is fully opened, the center shaft extends all the way through the funnel extension and handle of the hub unit 75. Also, as shown in FIG. 4, the top end and top opening of the funnel extension are preferably enlarged relative to the diameter of the preferred center shaft.

When the user wished to close the umbrella, he/she pulls down on the handle. That act supplies the force to pivot the push-rods down through, and below, the transverse ("horizontal") position into the open position wherein the umbrella bows and fabric are collapsed. Because the greatest compressive force against the push-rods occurs when they are transverse to the umbrella axis, closing the umbrella, and likewise opening the umbrella, may feel like a "snap" action as the push-rods moves down or up through the transverse position. There need be no other securement of the umbrella in the open position, because of this "snap" positioning of the push-rods into the open position.

The preferred hub unit comprises a transverse hub portion 175 that is a generally circular ring, and a funnel transversely received in the circular ring. The push-rods are pivotally connected to the circular ring around its circumference. The funnel member may be described as having an enlarged top opening, a vertical passage preferably all the way through the funnel to receive the center shaft 62 substantially along its entire length, and a lower end that serves as the handle 80. In this way, the preferred hub unit is made out of two main pieces (the circular ring and the funnel) which together serve the functions of hub, handle and funnel/guide. Alternatively, the circular ring and funnel may be manufactured as a single unit, wherein the three functions of hub, handle and funnel/guide are integrally included in a single molded, machined, or otherwise-manufactured unit.

Alternatively, the funnel may be replaced with a generally constant-diameter cylinder or other hollow member, which is large enough to easily receive the center shaft 62. Such an embodiment, however, is less preferred because such a constant-diameter member would not provide the guiding and centering functions afforded by the funnel.

Figure 5:
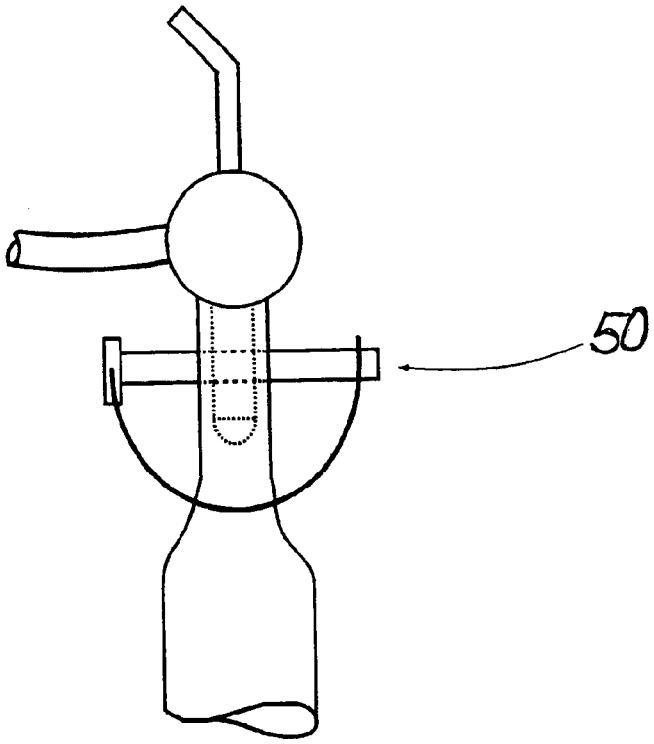
FIG. 5 is a side view of one embodiment of a quick-connection for connecting the mast to a raft frame or other surface or for adaptation to use at other locations in the support system of the invention.
Figure 6:
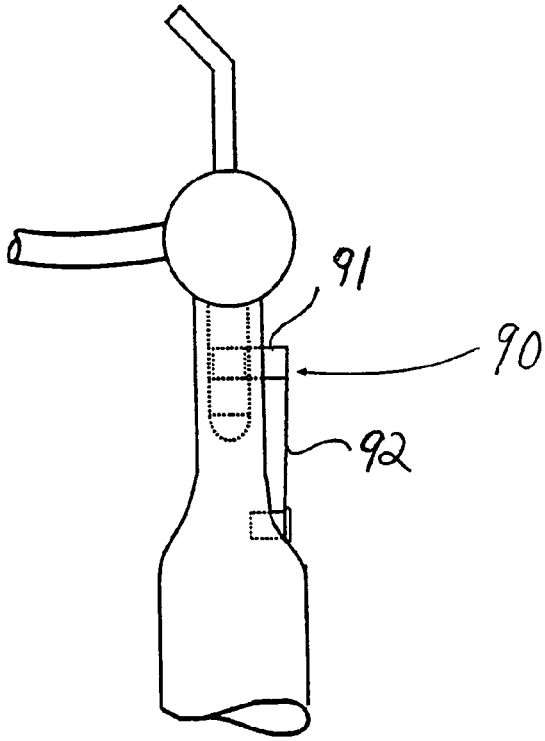
FIGS. 6, 7A, and 7B are side views of alternative embodiments of quick-connections for use in the support system of the invention.

Referring to FIGS. 5–11, there are shown alternative quick-connection designs that are some of many that may be used. Specifically, the FIG. 5 shows an enlarged view of the pin system 50 shown in FIGS. 2–4, with a half-ring retaining strap that swings around to attach to the end of the pin to retain the pin in the two members it connects. FIG. 6 is an alternative system in which a tab 91 pivots on a flexible arm 92 to extend through an aperture in the mast (the external tube of the connection) to engage a hole or recess in a downwardly-extending end of the arm (the internal tube of the connection). The flexible arm 92 may be designed to bias that tab 91 through the aperture and into the hole/recess, unless the user pulls the tab/flexible arm outward to remove the tab from the arm and mast, to allow the arm to be lifted up from the mast.

Figure 7A:
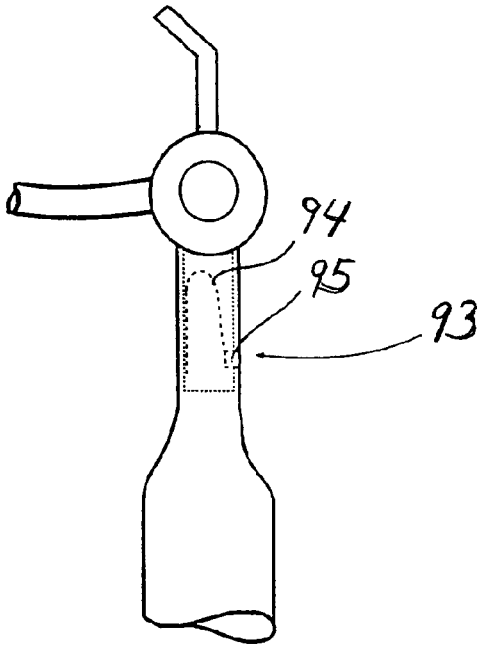
Figure 7B:
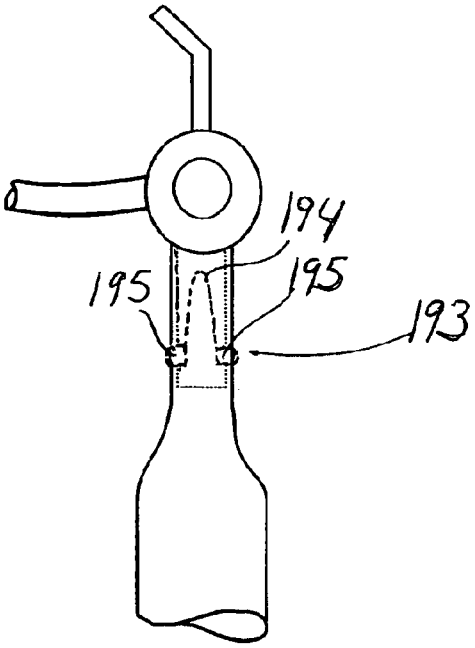

FIG. 7A illustrates a "single-snap-button" detent mechanism 93 for a quick-proximal end of the arm to engage in a hole in the mast. FIG. 7B illustrates an especially-preferred "double-snap-button" detent mechanism 193, in which a spring-style member 194 has snap-buttons 195 on both of its ends. Both of the snap-buttons 195 are biased outward through apertures in the proximal end of the arm and into holes in the mast. When the user wishes to disconnect the quick-connection, he/she pushes on both buttons 195 to the extent that they clear the mast and the arm can be removed from the mast. In some embodiments, such a double-snap-button mechanism 193 may be used for two or more of the quick-connections. For example, such a double-snap-button mechanism 193 may be used for the connection between the umbrella shade portion 30 and the arm 24, between the arm 24 and the mast 22, and between the mast 22 and the bracket system 40. By consistently using this preferred style of quick-connection for all the quick-connections of the invented umbrella system, secure and reliable connections may be achieved that are easily connected and disconnected by the user.

Figure 8:
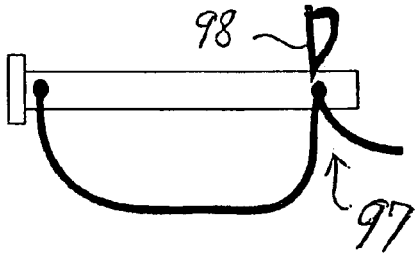
FIGS. 8–11 illustrate alternative pins and other fasteners that may be used in quick-connections according to alternative embodiments of the invention.
Figure 9:
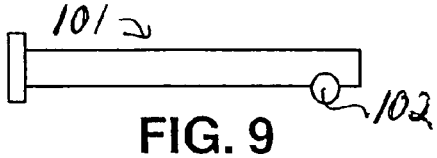
Figure 10:
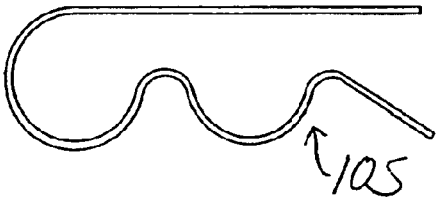
Figure 11:
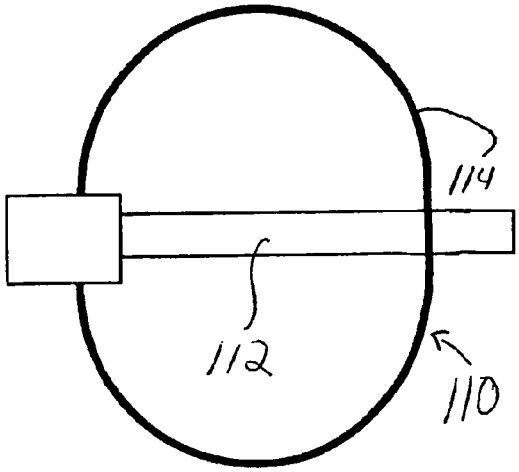

FIG. 8 illustrates a system 97 with a flexible retainer strap with a rigid member 98 near one end that may be pushed in and pulled out of a hole at the end of the pin. FIG. 9 illustrates a pin 101 with a detent ball 102 at the end. FIG. 10 illustrates an alternative pin 105 for use as a quick-connection. FIG. 11 illustrates a lich-pin style quick-connection 110, in which a pin 112 holds a ring 114 that may be flipped over the end of the pole/sleeve combination which the pin is pushed through, to prevent the pin 112 from being pulled out until the ring 114 is flipped back off of the pole/sleeve. In the case of the preferred embodiment, such a lich pin design may be used for the quick-connection between the arm and the umbrella, because the ring 114 may be flipped back and forth over the top of the cylindrical sleeve 64 and center shaft 62 combination.

Thus, the invented umbrella system is optimally used on rafts and moving vehicles. The preferred support system provides for the umbrella being suspended to the side of the mast, so that the support mast is not directly underneath the umbrella and does not interfere with people sitting underneath or placing objects underneath the umbrella. The support system preferably has an anchor system for securely attaching the support system to a rigid frame surface of the raft, a telescoping mast, and a pivotal arm for tilting the umbrella. The support system quick-connection/quick-disconnection systems allow the umbrella system to be quickly disassembled into several, shorter, more compact parts for easy transport and storage. The preferred umbrella opening and closing system does not include cables, cranks, or other complex structure, but rather is made from a handle underneath the center of the umbrella that can be manually pushed and pulled upward and downward, respectively, to open and close the umbrella. Pushing the handle moves a hub up toward the center of the umbrella shade, and, thus, moves rods underneath the shade into a slanted position, forming a concave formation when viewed from underneath the umbrella, that maintains the umbrella shade bows in an expanded open position. The umbrella system can be adjusted to shade a large area by a few simple adjustments of the pivotal joint, or by quick detachment of the support system from the raft and re-attachment in another location on the raft, for example. This effective and simple opening and closing system, the offset support system, and the quick-connection system, and a preferred ball joint or other pivotal joint on the arm combine to provide a quickly and simply operable, and light-weight umbrella for rafts, boats, and other non-stationary recreational settings.

In this Description and in the claims, the term "proximal" on the support system means nearer the end that connects to the raft or vehicle. The term "distal" means away from or opposite the proximal end, that is, away from the end the connects to the raft or vehicle.

Although this invention has been described above with reference to particular means, materials and embodiments, it is to be understood that the invention is not limited to these disclosed particulars, but extends instead to all equivalents within the scope of the following claims and within the broad scope of the following claims.

I claim:

1. An umbrella system comprising a support system having a mast axis and an umbrella portion having an umbrella axis, wherein the support system comprises:

a mast adapted to be anchored to a surface by a quickly-releasable connection at a proximal end of the mast; and a curved arm connected to a distal end of the mast by a quickly-releasable quick-connection; and wherein the umbrella portion is suspended from a distal end of the arm by a quick-releasable quick-connection, and the umbrella portion hangs down from the arm with said umbrella axis offset to a side of the mast so that no portion of the mast extends through the umbrella portion and so that the mast axis is not coaxial with the umbrella axis, wherein the umbrella portion further comprises:

a center member with a center shaft on said umbrella axis;

a hub on said umbrella axis below the center member but not attached to the center member or to the center shaft;

a plurality of bows radially extending out from the center member and supporting a fabric umbrella shade; and a plurality of push-rods each having an inner end and an outer end, the push-rods pivotally extending radially out from the hub and pivotally attaching to said plurality of bows at said push-rod outer ends;

wherein the umbrella portion is movable to an open positions wherein the hub is moveable up toward the center member so that the push-rods pivot to an inclined position with their outer ends in a plane transverse to the center axis, and with the inner ends above said plane so that the inner ends are closer to the center member than are their outer ends, and so that a top end of the hub abuts against the center member, and the umbrella portion is maintained in said open position by compression force on the push-rods by the fabric shade and by the hub abutting against the center member; and wherein the hub comprises a funnel-shaped hollow member with an enlarged diameter top end and a smaller-diameter lower end parallel to the umbrella axis, wherein, when the umbrella portion is opened, the enlarged diameter top end of the hollow member abuts against the center member and the center shaft extends into the smaller-diameter lower end so that the center shaft is maintained coaxial with the umbrella axis.

2. An umbrella system as in claim 1, wherein the support system comprises a lockable pivotal joint for adjusting the arm position relative to the mast to move the umbrella axis to be non-parallel to the mast axis.

3. An umbrella system as in claim 1, wherein the quickly-releasable connection at the proximal end of the mast comprises a u-bolt bracket tightenable around a cylindrical raft frame member.

4. An umbrella system as in claim 3, wherein the bracket comprises a quick-releasable pin inserted through the u-bracket and through the mast.

5. An umbrella system as in claim 1, wherein the quickly-releasable quick-connection connecting the curved arm to the distal end of the mast comprises a quick-releasable pin inserted through the curved arm and through the mast distal end.

6. An umbrella system as in claim 1, wherein the quickly-releasable quick-connection connecting the curved arm to the umbrella comprises a quick-releasable pin inserted through the curved arm and through an upward extension of the umbrella portion center member.

7. An the umbrella system comprising a support system having a mast axis and comprising no cables and an umbrella portion having an umbrella axis, wherein the support system comprises:

a mast adapted to be anchored to a surface by a quickly-releasable connection at a proximal end of the mast;

a curved arm connected to a distal end of the mast by a quickly-releasable quick-connection; and an adjustable and lockable joint adapted to adjust and lock the position of the curved arm relative to the mast;

wherein the umbrella portion is suspended from a distal end of the arm by a quick-releasable quick-connection, and the umbrella portion hangs down from the arm with said umbrella axis offset to a side of the mast so that no portion of the mast extends through the umbrella portion and so that the mast axis is no coaxial with the umbrella axis; and wherein the umbrella portion further comprises:

a center member with a center shaft on said umbrella axis;

a hub on said umbrella axis below the center member but not attached to the center member or to the center shaft;

a plurality of bows radially extending out from the center member and supporting a fabric umbrella shade;

a plurality of push-rods each having an inner end and an outer end, the push-rods pivotally extending radially out from the hub and pivotally attaching to said plurality of bows at said push-rod outer ends;

wherein the umbrella portion is movable to an open position, wherein the hub is moveable up toward the center member so that the push-rods pivot to an inclined position with their outer ends in a plane transverse to the center axis, and with the inner ends above said plane so that the inner ends are closer to the center member than are their outer ends, and so that a top end of the hub abuts against the center member, and the umbrella portion is maintained in said open position by compression force on the push-rods by the fabric shade and by the hub abutting against the center member; and wherein the hub comprises a funnel-shaped hollow member with an enlarged diameter top end and a smaller-diameter lower end parallel to the umbrella axis, wherein, when the umbrella portion is opened, the enlarged diameter top end of the hollow member abuts against the center member and the center shaft extends into the smaller-diameter lower end so that the center shaft is maintained coaxial with the umbrella axis.

8. The umbrella system as in claim 7, wherein said quick-connections between the umbrella portion and the arm, between the arm and the mast, and between the mast and the surface are all double-snap-button mechanisms.

9. A raft system comprising:

a raft having a frame surface, and an umbrella system connected to the raft comprising:

a support system having a mast axis and an umbrella portion having an umbrella axis, wherein the support system comprises:

a mast anchored to said raft frame surface by a quickly-releasable connection at a proximal end of the mast; and a curved arm connected to a distal end of the mast by a quickly-releasable quick-connection;

wherein the umbrella portion is suspended from a distal end of the arm by a quick-releasable quick-connection, and the umbrella portion hangs down from the arm with said umbrella axis offset to a side of the mast so that no portion of the mast extends through the umbrella portion and so that the mast axis is no coaxial with the umbrella axis;

wherein the umbrella portion comprises:

a center member with a center shaft on said umbrella axis;

a hub on said umbrella axis below the center member but not attached to the center member or to the center shaft;

a plurality of bows radially extending out from the center member and supporting a fabric umbrella shade; and a plurality of push-rods each having an inner end and an outer end, the push-rods pivotally extending radially out from the hub and pivotally attaching to said plurality of bows at said push-rod outer ends;

wherein the umbrella portion is movable to an open position, wherein the hub is moveable up toward the center member so that the push-rods pivot to an inclined position with their outer ends in a plane transverse to the center axis, and with the inner ends above said plane so that the inner ends are closer to the center member than are their outer ends, and so that a top end of the hub abuts against the center member, and the umbrella portion is maintained in said open position by compression force on the push-rods by the fabric shade and by the hub abutting against the center member; and wherein the hub comprises a funnel-shaped hollow member with an enlarged diameter top end and a smaller-diameter lower end parallel to the umbrella axis, wherein, when the umbrella portion is opened, the enlarged diameter top end of the hollow member abuts against the center member and the center shaft extends into the smaller-diameter lower end so that the center shaft is maintained coaxial with the umbrella axis.

10. The raft system as in claim 9, wherein said quick-connections between the umbrella portion and the arm, between the arm and the mast, and between the mast and the surface are all double-snap-button mechanisms.

11. An umbrella system comprising a support system and an umbrella portion, wherein the support system comprises:

a mast having a proximal end adapted to be anchored to a surface, a distal end, and a mast axis; and a curved arm connected to the distal end of the mast; wherein the umbrella portion has an umbrella axis and is suspended from a distal end of the curved arm so that said umbrella axis is offset to a side of the mast axis, the umbrella portion further comprising:

a center member, and a center shaft extending down from said center member on said umbrella axis and having a center shaft diameter;

a hub below the center member but not attached to the center member or to the center shaft, the hub comprising a hollow member parallel to the umbrella axis and having a top opening that is enlarged relative to the center shaft diameter; and a plurality of bows radially extending out from the center member and supporting a fabric umbrella shade;

a plurality of push-rods each having an inner end and an outer end, the push-rods pivotally extending radially out from the hub and pivotally attached to said plurality of bows at said push-rod outer ends;

wherein the hub is moveable up toward the center member to pivot the push-rods first to a position perpendicular to the umbrella axis and then to an inclined position wherein the inner ends are closer to the center member than are their outer ends, and so that a top end of the hub abuts against the center member, and the umbrella portion is maintained in an open position by compression force on the push-rods by the fabric shade and the hub abutting against the center member; and wherein the center shaft and the hub are adapted so that, when the umbrella portion is being opened, the hollow member top opening receives said center shaft prior to the push-rods pivoting to said position perpendicular to the umbrella axis; and wherein the hollow member is funnel-shaped with an enlarged diameter top end that comprises said top opening and a smaller-diameter lower end parallel to the umbrella axis, wherein, when the umbrella portion is opened, the enlarged diameter top end of the hollow member abuts against the center member and the center shaft extends into the smaller-diameter lower end so that the center shaft is maintained coaxial with the umbrella axis.

12. An umbrella system comprising a support system and an umbrella portion, wherein the support system comprises:

a mast having a proximal end adapted to be anchored to a surface, a distal end, and a mast axis; and a curved arm connected to the distal end of the mast; wherein the umbrella portion has an umbrella axis and is suspended from a distal end of the curved arm so that said umbrella axis is offset to a side of the mast axis, the umbrella portion further comprising:

a center member, and a center shaft extending down from said center member on said umbrella axis and having a center shaft diameter;

a hub below the center member but not attached to the center member or to the center shaft, the hub comprising a hollow member parallel to the umbrella axis and having a top opening that is enlarged relative to the center shaft diameter; and a plurality of bows radially extending out from the center member and supporting a fabric umbrella shade;

a plurality of push-rods each having an inner end and an outer end, the push-rods pivotally extending radially out from the hub and pivotally attached to said plurality of bows at said push-rod outer ends;

wherein the hub is moveable up toward the center member to pivot the push-rods first to a position perpendicular to the umbrella axis and then to an inclined position wherein the inner ends are closer to the center member than are their outer ends, and so that a top end of the hub abuts against the center member, and the umbrella portion is maintained in an open position by compression force on the rush-rods by the fabric shade and the hub abutting against the center member; and wherein the center shaft and the hub are adapted so that, when the umbrella portion is being opened, the hollow member top opening receives said center shaft prior to the push-rods pivoting to said position perpendicular to the umbrella axis;

wherein the push-rods are generally at 45 degrees to said umbrella axis when said hollow member receives said center shaft; and wherein the hollow member is funnel-shaped with an enlarged diameter top end that comprises said top opening and a smaller-diameter lower end parallel to the umbrella axis, wherein, when the umbrella portion is opened, the enlarged diameter top end of the hollow member abuts against the center member and the center shaft extends into the smaller-diameter lower end so that the center shaft is maintained coaxial with the umbrella axis.

* * * * *